United States Patent [19]

Schlictig

[11] Patent Number: 5,071,328

[45] Date of Patent: Dec. 10, 1991

[54] DOUBLE ROTOR COMPRESSOR WITH TWO STAGE INLETS

[76] Inventor: Ralph C. Schlictig, 11212 Third Ave. South, Seattle, Wash. 98168

[21] Appl. No.: 529,336

[22] Filed: May 29, 1990

[51] Int. Cl.[5] ..... F04C 18/20

[52] U.S. Cl. ..... 418/15; 418/178; 418/191; 418/227

[58] Field of Search ..... 418/15, 178, 191, 227

[56] References Cited

U.S. PATENT DOCUMENTS

| | | | |
|---|---|---|---|
| 1,207,306 | 12/1916 | Lestak | 418/15 |
| 2,833,224 | 5/1958 | Meyer et al. | 418/178 |
| 3,386,341 | 6/1968 | Angulo | 418/15 |
| 3,843,284 | 10/1974 | Spinnett | 418/191 |

FOREIGN PATENT DOCUMENTS

| | | | |
|---|---|---|---|
| 1324941 | 3/1963 | France | 418/191 |
| 284562 | 11/1952 | Switzerland | 418/191 |

*Primary Examiner*—John J. Vrablik

*Attorney, Agent, or Firm*—David L. Tingey

[57] ABSTRACT

An oilless double rotor, rotary gas compressor with second stage inputs for precompressed gas is described. A compression rotor having at least three lobes which match in intersection to cavities in a counterrotating valving rotor providing an extended sealing surface. The lobes further provide an extended, near-contact surface with the housing with adjacent lobes defining successive compression chambers. Second stage ports are also provided for input of precompressed gas for use with energy recovery systems. A discharge equalization passage is provided in association with a discharge port for efficient gas exhaust.

12 Claims, 2 Drawing Sheets

DOUBLE ROTOR COMPRESSOR WITH TWO STAGE INLETS

TECHNICAL FIELD

This invention relates to gas compressors and more specifically to double rotor, positive displacement compressors. This invention primarily comprises an oilless gas compressor having a drive rotor with three or more lobes that provide compression on rotor rotation, a second cylindrical rotor with recessed cavities matching the drive rotor lobes and serving as a rotating valve regulating discharge to a discharge port, a traditional first stage inlet port for receiving unpressurized gas, two second stage inlet ports for receiving partially compressed gas, and an external pressure equalizing passage adjacent the compressed gas discharge port.

BACKGROUND OF THE INVENTION

Typical prior art compressors, such as Paget, U.S. Pat. No. 4,457,680, have but two lobes on the main rotor, which does not permit second stage ports for precompression. Also, prior art double rotor compressors usually employ similar contoured rotors, which are geared together, each serving as a compression rotor, such as Ingersoll Rand, U.S. Pat. No. 4,O68,988. Input power to one rotor is generally shared equally with the other rotor through interconnecting gears causing heavy loads and employing lubricants is required to minimize considerable wear caused therefrom. In contrast, this invention places most of the load on a single drive rotor which alone employs compression lobes. The second rotor, smaller than the compression rotor, functions as a rotary valve to eliminate sliding valves. This minimizes wear on rotor drive means, such as interconnecting gears, and reduces or eliminates the need for lubricants.

Complex contoured rotor surfaces typically found in the art also present difficulties in manufacture. In contrast, the rotors of this compressor have extended cylindrical surfaces easier to machine with the accuracy required for gas enclosure than that for complex contoured surfaces.

OBJECTS OF THE INVENTION

It is the object of the present invention to provide an oilless rotary compressor.

Another object is to provide a compressor having a second stage input port for input of gas at a pressure intermediate the pressure of the gas at the primary input and the pressure at the compressor discharge port which is useful, for example, in recovering heat from a flash chamber as precompressed vapor to the compressor.

A further object is to provide a compressor that experiences minimum wear.

A further object is to provide a compressor that minimizes the effects of normal wear on compression.

A final object is to provide a compressor with rotor configurations that are easy to machine accurately.

SUMMARY OF THE INVENTION

The present invention provides an oilless rotary gas compressor with second stage inputs for precompressed gas. Power is provided to a compression rotor which in turn causes counter rotation through interconnecting gears to a smaller valving rotor. The cylindrical compression rotor has three or more compression lobes matched with close tolerance to cavities in the valve rotor. The lobes are further formed to provide an extended outer cylindrical surface in near contact with the inner housing surface.

A plurality of secondary input ports is positioned to communicate successively with each of the plurality of chambers between adjacent compression rotor lobes, with housing chamber wall providing a common bounding wall. Secondary ports may also be in the area housing the valve rotor with rotor cavities capturing gas as each passes a secondary port.

An equalization passage is provided around an exhaust port to pressurize the valve rotor cavity before discharge to prevent reverse gas flow upon discharge. As the cavity continues rotation it becomes the conduit of pressurized gas from a compression chamber to the exhaust port. An adjustable valve may also be provided between the exhaust port and the equalization passage to regulate and modify pressure output.

DESCRIPTION OF THE PREFERRED EMBODIMENTS

Figure 2:
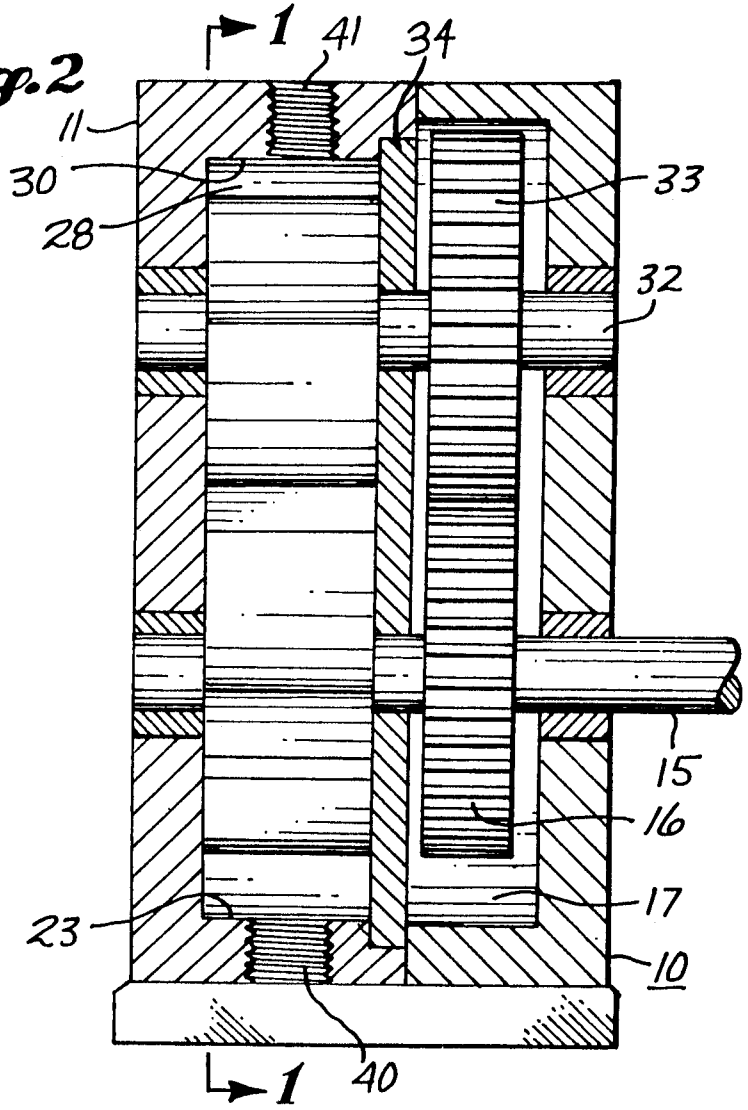
FIG. 2 is a side cross sectional view of the compressor showing rotors and associated gears in the compressor housing.
Figure 1:
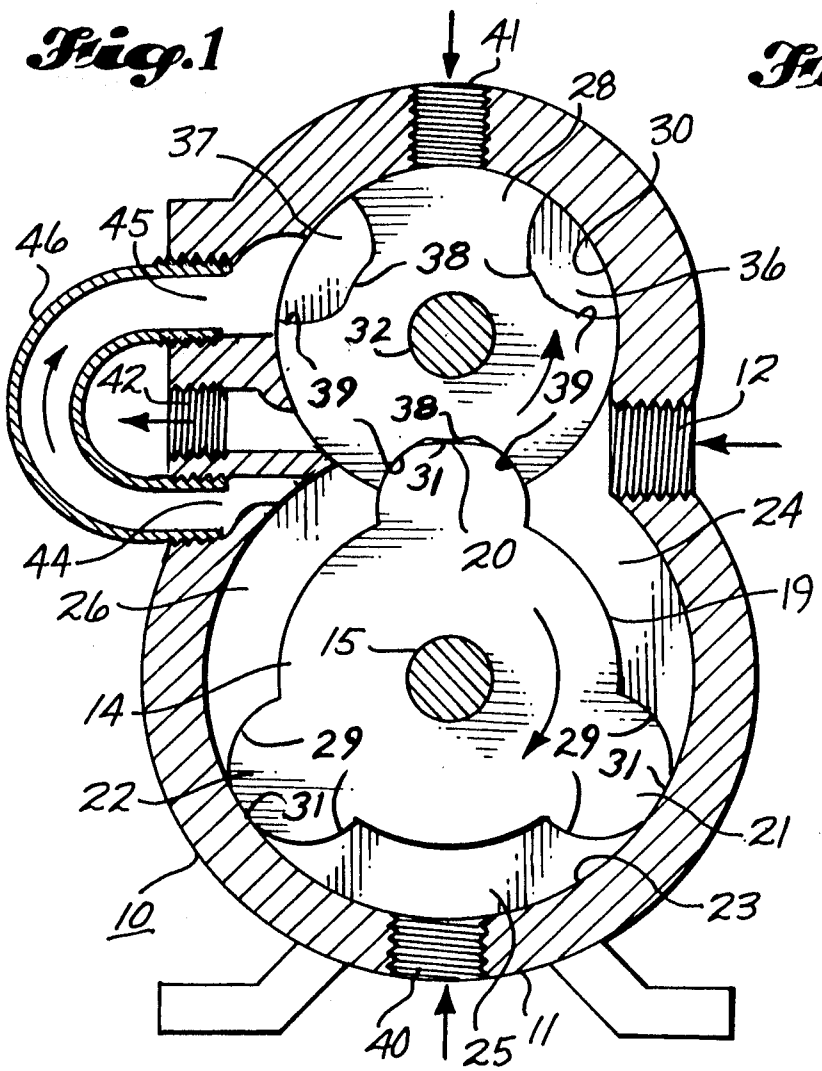
FIG. 1 is a cross sectional view of the compressor through the rotor section showing rotors and housing chambers with primary and secondary input and output ports and equalization passage.

Referring to FIG. 1 and FIG. 2, in its usual configuration, the present invention is a double rotor positive displacement, two stage compressor 10 principally comprising a housing 11 with first inner housing chamber bounded by first inner cylindrical surface 23 and smaller second inner housing chamber bounded by smaller second inner cylindrical surface 30 connected to the first inner housing chamber such that the combined cavities present an apparent overlap of two cylindrical cavities. In the two housing cavities are mounted a pair of counter rotating rotors, a compression rotor 14 in a first housing chamber and a valve rotor 28 smaller than the compression rotor 14 in the second housing chamber. The compression rotor 14 is rigidly connected to a drive shaft 15 mounted to a first gear 16 and available to a drive power source external to the housing. The valve rotor 28 is similarly rigidly connected to a second shaft 32 mounted to second gear 33, shafts 15 and 32 being in parallel. Mounted in gear housing chamber 17 and separated from rotor housing cavities by separating plate 34, which provides a lower boundary to closed rotor cavities, are gears 16 and 33, gear 16 being driven by gear 33 such that rotors 14 and 28 are in rolling contact, or near contact, with equal circumferential speed, providing thereby an effective gas seal. Gears may be made of or coated with materials having minimum wear characteristics.

Cylindrical compression rotor 14 further comprises a plurality of at least three lobes 20, 21, and 22 equally spaced apart and extending from the cylindrical body 19. The lobes form an extended cylindrical surface of 30 or fewer degrees in near contact with and having the same radius of curvature as cylindrical inner housing surface 23 in which the rotor is mounted thereby providing an effective gas (hermetic) seal between the rotor and the housing, adjacent lobes defining compression chambers 24, 25 and 26.

Valve rotor 28 comprises a cylinder in near contact with second inner housing surface 30 and having a plurality of three or more recessed lobe cavities 35, 36, and 37 equally spaced apart and shaped to match the lobes on the compression rotor such that on counter rotation of the rotors, a compression rotor lobe inserts with close fit into a valve rotor cavity, providing a effective gas seal. The side curvature 39 of valve rotor cavities 35, 36 and 37 is defined by the trace made by the edge of the outer cylindrical surface of a lobe from the outer cylindrical surface of the valve rotor to its most inward extent during intersection of the rotors in rotation, the opposite cavity wall being symetrical. Further, a bottom surface 38 of each cavity is a segment of a cylindrical surface, concentric with the valve rotor, of radius equal to the valve rotor radius minus the extension of a lobe beyond the compression rotor radius and of the same angular extent as the outer cylindrical surface. This curvature surface maintains a rolling contact, or near contact, with compression rotor lobe 20, 21 or 22 over a portion of the rotation of the rotors providing thereby an effective seal while minimizing manufacture tolerance and wear effects. Side surfaces 29 of rotor lobes 20, 21, and 22 are formed to match the valve rotor cavities so defined, thereby providing, in conjunction with cavity bottom surface 38 and extended lobe contact surface 31, and effective seal while minimizing manufacture tolerance and wear effects.

Rolling contact, or near contact, is maintained during counterrotation of rotors either between the valve cavity bottom surface 38 and the extended lobe contact surface 31 or between the cylindrical valve rotor 28 and the cylindrical compression rotor 14. Rolling contact surfaces may be coated with a pliable material 19 to assure rolling surface contact without damage and to compensate for wear and manufacture tolerances while providing an effective gas seal.

With this lobe and cavity design with counter rotating rotors in rolling contact, or near contact, outside of the lobe and cavity intersections, it is recognized that wear of drive means such as gears results mostly in relaxation of rotor timing but does not cause a loss in compression.

Through the housing, lateral to the intersection of the first inner housing chamber and the smaller second inner housing chamber, is a primary gas input port 12. Through the housing into the smaller second inner housing chamber nominally opposite the primary gas input port is a primary gas discharge port 42. On two sides of the primary gas discharge port 42 are secondary discharge ports, 44 and 45 respectively, which are connected by a pressure equalizing tube 46 for maximum efficiency in discharging compressed gas at high compression, avoiding reverse flow of gas through primary discharge port 42.

The invention as thus far described can also function as a gas driven motor by simply reversing the main gas flow and the direction of rotation of the rotors.

For discharge of gas at lower compression than maximum, an orifice 47 can be included between the secondary discharge port 44 and the primary discharge port 42. An adjustable valve 48 may be employed on the orifice 47 to regulate discharge pressure.

Spaced between the primary gas input port 12 and discharge port 42 and into the first inner housing chamber is a compression rotor secondary input port 40. Similarly, spaced between the primary gas input port 12 and discharge port 42 and into the second inner housing chamber are one or more compression chamber secondary input ports 41. Secondary input ports are useful in exploiting gas available at pressure higher than that of the primary gas input, for example, when gas is available from an energy recovery system but in volumes less than required by the compressor at the primary input.

Secondary ports 40 and 41 (shown as a single port in the figures) are sized smaller than the respective rotor contact surface, extended lobe contact surface 31 for the compression rotor secondary ports 40 and the cylindrical valve rotor itself for secondary ports 41, such that the inlet is effectively closed when a contact passes over it.

OPERATION OF THE INVENTION

During operation of the rotary compressor, gas from a lower pressure primary source enters the housing 11 of the compressor 10 through a primary gas input port 12 and flows into a compression chamber 24 between adjacent lobes 20 and 21 of the compression rotor 14, which chamber in fact is expanding during the primary input phase of rotation. Gas from the same port also fills a valve rotor cavity as it rotates past the primary input port 12.

Figure 3:
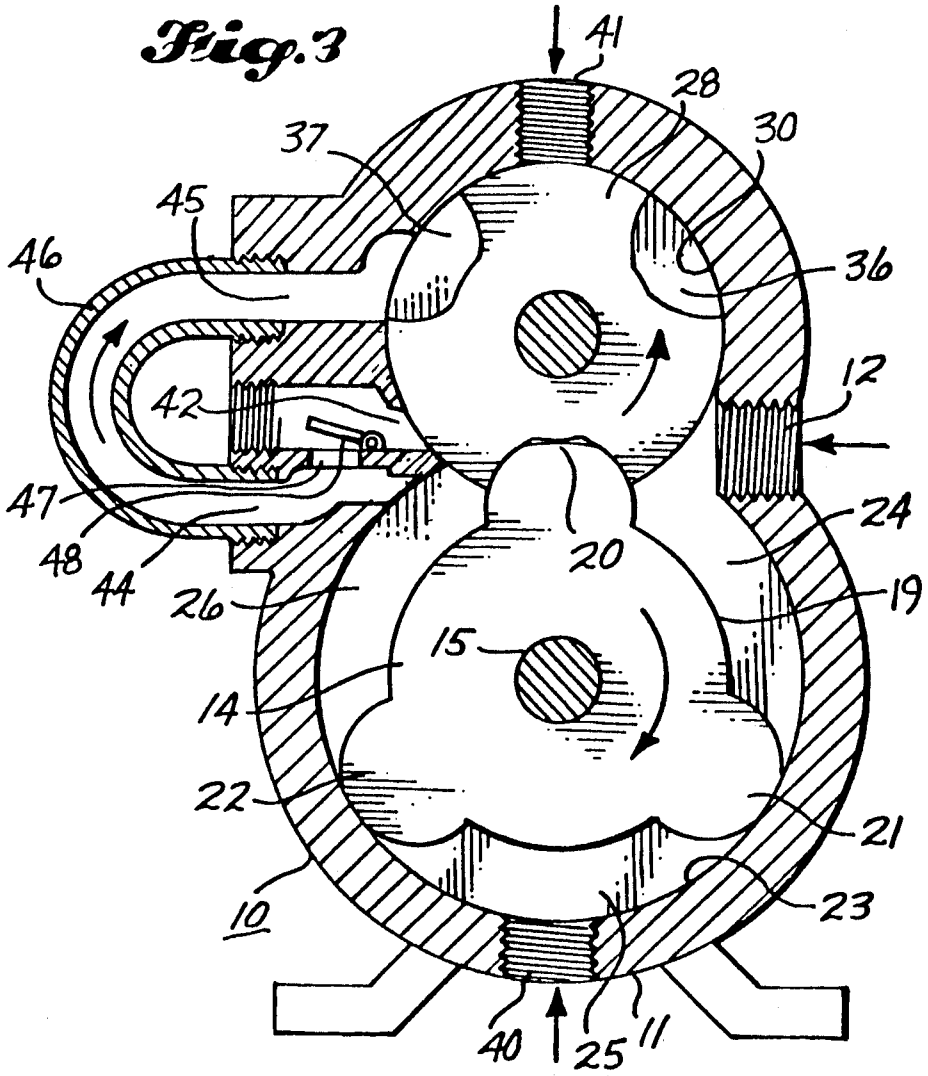
FIG. 3 is a cross sectional view of the compressor through the rotor section additionally showing a valve between the equalization passage and the discharge port.

As an interlobe compression chamber 25 and valve rotor cavity 36 in FIG. 3 rotate past second stage input ports 40 and 41, respectively, they receive an additional charge of gas from a more limited supply at a higher pressure than the gas pressure at the first stage inlet 12. As lobe 22 continues to rotate, the volume of the interlobe cavity 26 is decreased by the fixed boundary of the valve rotor 28, which further compresses the enclosed gas. Before opening the compression chamber for discharge increased pressure is shared through small equalization passage 46 connecting secondary discharge ports 44 and 45 with valve rotor cavity 37. This pressure equalization means eliminates energy losses due to sudden reverse flow that would otherwise occur through discharge port 42. As rotation continues and gas compression continues to completion, valve cavity 37 first comes into communication with the discharge part 42, then directly with compression chamber 26 during which time fully compressed gas is discharged through discharge port 42.

Having described the invention, what is claimed is:

1. A double rotor, positive displacement compressor comprising a housing with a partial cylindrical first inner housing chamber and a smaller partial cylindrical second inner housing chamber forming a first junction on a first housing side and a second junction on a second housing side opposite the first housing side, a compression rotor mounted in the first inner housing chamber and comprising a cylindrical body with a plurality of at least three spaced-apart lobes, each with an outer lobe contact surface, the lobes extending in the cylindrical first inner housing chamber to near contact of the lobe contact surface with the housing, defining thereby between the compression rotor and the housing a plurality of compression chambers, a cylindrical valve rotor mounted in the second inner housing chamber and comprising a cylindrical surface in near contact with the housing and having a plurality of three or more spaced-apart lobe cavities recessed in the valve rotor and shaped to match the lobes on the compression rotor such that, on counter rotation of the rotors, the valve rotor and the compression rotor cylindrical body counterrotate in rolling contact or near contact with the compression rotor lobe inserting in close fit into a valve rotor cavity, means to rotationally drive the compression rotor, means for rotation of the compression rotor to drive the valve rotor in counterrotational synchronization, a primary gas input port in the housing nominally lateral the rotors at the first junction of inner housing chambers, a primary gas discharge port in the housing nominally opposite the primary gas input port and close to a compression chamber such that during a phase of valve rotor rotation for each cavity, a valve rotor cavity provides a conduit between a compression chamber and the discharge port, one or more secondary input ports in the first inner housing chamber located to admit gas into a compression chamber at a pressure higher than gas pressure at the primary gas input port while the compression chamber is effectively sealed from the primary input port and the primary gas discharge port by compression rotor lobes.

2. A compressor as described in claim 1 wherein the compression rotor lobe presents an extended lobe contact surface, about 30 degrees or less in angular extent, and in near contact with the housing to make an effective hermetic seal.

3. A compressor as described in claim 2 wherein the secondary port is sized smaller than the compression rotor lobe contact surface such that the port is effectively closed by the lobe contact surface when positioned over it.

4. A compressor as described in claim 1 further comprising a first and a second secondary discharge port, one on each side of the primary gas discharge port, interconnected by a pressure equalizing tube.

5. A compressor as described in claim 4 further comprising an orifice for reducing compression located between a secondary discharge port and the primary discharge.

6. A compressor as described in claim 4 further comprising a valve over the orifice to regulate discharge pressure.

7. A compressor as described in claim 1 in which the cylindrical valve rotor cavity further comprises a first cavity side curvature defined by a trace made by an outer lateral edge of the lobe contact surface from an outer valve rotor surface to a most inward extent of the lobe in intersection with the valve rotor with the compression rotor lobe and the valve rotor in rolling contact in counterrotation, a second valve cavity wall being symmetrical with the first valve cavity, and in which side surfaces of rotor lobes are formed to match the valve rotor cavity.

8. A compressor as described in claim 7 in which a bottom surfaces of each valve rotor cavity is a segment of a cylindrical surface concentric with the valve rotor having a radius equal to a valve rotor radius minus a distance of a compression lobe most extended beyond the compression rotor cylindrical body.

9. A compressor as described in claim 8 in which the bottom surface of each cylindrical valve rotor cavity has a same angular extent as does the extended lobe contact surface thereby maintaining nonsliding, rolling contact, or near contact, with the extended lobe contact surface over the angular extent.

10. A compressor as described in claim 9 in which rolling contact, or near contact, is maintained during counterrotation of rotors either between the valve cavity bottom surface and the extended lobe contact surface or between the valve rotor cylindrical surface and the compression rotor cylindrical body.

11. A compressor as described in claim 1 in which contact surfaces are coated with a pliable material.

12. A double rotor, positive displacement compressor comprising a housing with a partial cylindrical first inner housing chamber and a smaller partial cylindrical second inner housing chamber forming a first junction on a first housing side and a second junction on a second housing side opposite the first housing side, a compression rotor mounted in the first inner housing chamber and comprising a cylindrical body with a plurality of at least three spaced-apart lobes, each with an outer lobe contact surface, the lobes extending in the cylindrical first inner housing chamber to near contact of the lobe contact surface with the housing, defining thereby between the compression rotor and the housing a plurality of compression chambers, a cylindrical valve rotor mounted in the second inner housing chamber and comprising a cylindrical surface in near contact with the housing and having a plurality of three or more spaced-apart lobe cavities recessed in the valve rotor and shaped to match the lobes on the compression rotor such that, on counter rotation of the rotors, the valve rotor and the compression rotor cylindrical body counterrotate in rolling contact or near contact with the compression rotor lobe inserting in close fit into a valve rotor cavity, means to rotationally drive the compression rotor, means for rotation of the compression rotor to drive the valve rotor in counterrotational synchronization, a primary gas input port in the housing nominally lateral the rotors at the first junction of inner housing chambers, a primary gas discharge port in the housing nominally opposite the primary gas input port and close to a compression chamber such that during a phase of valve rotor rotation for each cavity, a valve rotor cavity provides a conduit between a compression chamber and the discharge port, a precompressing input port in the smaller second inner housing chamber for precharging the valve rotor cavity.

* * * * *